United States Patent [19]

Jundt et al.

[11] 4,077,377

[45] Mar. 7, 1978

[54] PROTECTIVE CIRCUIT FOR THE IGNITION SYSTEM OF AN INTERNAL COMBUSTION ENGINE

[75] Inventors: Werner Jundt, Ludwigsburg; Bernd Bodig, Leinfelden; Helmut Roth, Stuttgart; Gerhard Söhner, Remshalden; Peter Werner, Stuttgart, all of Germany

[73] Assignee: Robert Bosch GmbH, Stuttgart, Germany

[21] Appl. No.: 725,163

[22] Filed: Sep. 21, 1976

[30] Foreign Application Priority Data

Sep. 25, 1975 Germany ..... 2542776

[51] Int. Cl.[2] ..... F02P 1/00

[52] U.S. Cl. ..... 123/148 S; 315/209 T

[58] Field of Search ..... 123/148 S, 148 E; 315/209 R, 209 T

[56] References Cited

U.S. PATENT DOCUMENTS 3,745,985 7/1973 Hohne ..... 123/148 S 3,854,466 12/1974 Steinberg ..... 123/148 S

FOREIGN PATENT DOCUMENTS 1,539,168 11/1969 Germany ..... 123/148 S

*Primary Examiner*—Ronald B. Cox

*Attorney, Agent, or Firm*—Flynn & Frishauf

[57] ABSTRACT

To prevent a spurious inductive spark when the master ignition switch of the vehicle is opened with the breaker terminals closed, so that current stored in the ignition coil might cause a spurious inductive voltage pulse, a protective circuit branch is connected in parallel across the primary of the ignition coil and includes an auxiliary semiconductor short-circuiting switch, preferably a thyristor, the conduction of which is controlled to close by an auxiliary control circuit which senses opening of the master ignition switch and permits application of a portion of the inductive current flow to the gate of the thyristor to render it conductive, thus short-circuiting the primary of the ignition coil and preventing an inductive voltage kick which might cause a spurious spark.

10 Claims, 1 Drawing Figure

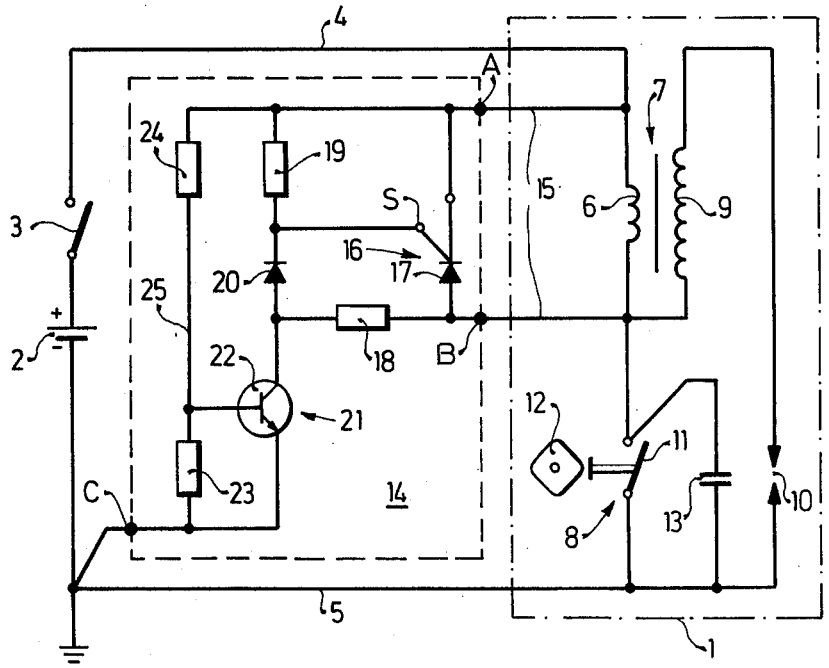
4
A
7
24
19
15
6
9
3
S
16
17
20
25
2
18
B
22
21
12
11
C
23
14
13
10
8
5
1

PROTECTIVE CIRCUIT FOR THE IGNITION SYSTEM OF AN INTERNAL COMBUSTION ENGINE

The present invention relates to ignition systems for internal combustion engines, and more particularly to a protective circuit for such an ignition system which protects the system against generation of spurious voltage pulses upon opening of the master ignition switch if the ignition system should, at that time, be controlled to be conductive.

Various types of ignition systems have been proposed — see, for example, German Disclosure Document DT-OS 15 39 168 — in which a situation may arise that the master ignition switch is opened at a time when the ignition breaker control switch happens to be closed. This will cause an ignition pulse to be generated in the secondary of the ignition coil. Compressed fuel-air mixture in the cylinder of the internal combustion engine can then be ignited, which ignition may occur at an undesirable point in time, causing damage to the engine or at least severe stress to its components and the components of the drive train or of the vehicle as a whole.

It is an object of the present invention to provide a protective circuit in which generation of an ignition spark is prevented when the ignition breaker contact is closed and the master ignition switch is opened.

SUBJECT MATTER OF THE PRESENT INVENTION

Briefly, a protective circuit branch is connected in parallel with the primary of the ignition coil. The protective circuit branch includes a semiconductor controlled short-circuiting switch, preferably a thyristor, and an auxiliary control circuit therefor connected to the short-circuiting switch, preferably to the gate electrode of the thyristor, and which applies current to the gate electrode of the thyristor derived from the inductive current in the ignition coil to render the auxiliary short-circuiting switch, that is, the thyristor in the preferred embodiment, conductive when the auxiliary control circuit senses that the master ignition switch is being opened.

The invention will be described by way of example with reference to the accompanying drawings, wherein the single FIGURE is an illustrative schematic circuit diagram of the system.

The basic ignition circuit 1, shown in broken lines, is intended for association with an ignition controlled internal combustion engine (not shown), preferably for use with an automotive vehicle. Current is supplied to the system 1 from a d-c source 2, preferably the battery of the automotive vehicle. The battery 2 is connected to a positive bus 4 and a negative bus 5. The main ignition switch 3 is included in series between the positive bus 4 and the battery 2. It is this switch which, when opened, may cause a spurious spark if the breaker contact switch 8 should, at that time, be closed.

The positive bus 4 is connected to the primary winding 6 of ignition coil 7 and then through a breaker switch 8 to the negative, ground or chassis bus 5. The secondary 9 of the ignition coil 7 is connected to one or more spark plugs 10, shown only schematically; the usual distributor can be interposed between the secondary 9 and the various spark plugs 10 when the system is used in multi-cylinder internal combustion engines.

The breaker switch 8, in its simplest form, can be a mechanical breaker contact 11 which opens under control of a control cam 12 rotating in synchronism with the crankshaft of the internal combustion engine. A capacitor 13 is connected across the terminals of switch 11 to suppress contact sparking.

The breaker switch 8 need not be a mechanical system; it may also be formed by the emitter-collector path of a transistor which is controlled by a mechanical switch or by a contactless control arrangement operating, for example, in conjunction with a transducer providing signals similar to the output from a-c generators which control the ignition control transistor, preferably through one or more flip-flop or other wave-shaping circuits.

In accordance with the present invention, the protective circuit 14, and shown in broken lines, is provided to suppress an ignition pulse if the switch 8 should be closed and the master ignition switch 3 is opened, for example by the operator. The protective circuit 14 includes a circuit branch 15 which is connected in parallel with the primary 6 of the ignition coil. The protective circuit branch includes a controlled auxiliary semiconductor short-circuiting switch 16, preferably formed by a thyristor 17. The cathode of the thyristor 17 is connected to the terminal of the ignition coil which is also connected to the positive current supply bus 4; the anode of the thyristor 17 is connected to the opposite terminal of the primary 6 of the ignition coil.

An auxiliary control circuit is connected to the thyristor 17 to control its conduction. It includes two control resistors 18, 19, of which the control resistor 18 has a relatively high value. The junction between the two resistors 18, 19 is connected through a blocking diode 20 to the control electrode S of the thyristor 17. The diode 20 has its anode connected to the junction of the resistors, and its cathode to the gate S of thyristor 17. A further branch extends from the junction and includes an auxiliary control switch 21, formed as the emitter-collector electrode path of a transistor 22. The transistor 22, of the npn-type, has its collector connected to the junction between the anode of diode 20 and resistor 18. The emitter is connected to ground or chassis bus 5. The base of the transistor 22 is connected to the tap or junction line 25 of a voltage divider formed by resistors 23, 24 and connected between the terminal of branch 15 connected to the positive terminal of the ignition coil 6 and to ground or chassis potential.

It is to be noted that the protective circuit 14 has only three end terminals which are connectable to readily accessible elements in any automotive vehicle: Across the primary of the ignition coil 7, that is, terminals A and B, and to chassis or ground, at terminal C. This latter terminal may be formed, for example, by the housing of the protective circuit which can be formed as a unit for later addition to existing ignition systems, or incorporated as a unit in newly constructed ignition systems.

Operation: Upon closing of operating switch 3 and starting of the internal combustion engine, the breaker contact 8 will cyclically open and close. The controlled switch 8 will thus, cyclically, store ignition energy and interrupt stored energy which will result in inductive sparks through the coil 7 and secondary 9 thereof which provides ignition voltage pulses for spark plugs 10. Blocking diode 20 prevents biassing the control electrode S with respect to the cathode in a negative direction upon generation of an ignition voltage pulse.

The emitter-collector path of transistor 22 of the auxiliary switch 21 is conductive when the operating switch 3 is closed, since current applied to the junction or tap line 25 over the voltage divider 23, 24 provides for current flow through the resistor 24 to the base-emitter path of transistor 22. As a result, current due to stored ignition energy which branches over the high resistance resistor 18 to the ground bus 5 can be drained off through the conductive transistor 22, and no control effect will occur at the gate electrode S of thyristor 17 forming the short-circuiting switch 16.

When the breaker switch 11 forming the control switch 8 closes again, ignition energy will be stored in coil 7 for the next ignition cycle. If, at that instant of time, the master ignition switch 3 is opened, control current to the auxiliary controlled switch 21 formed by transistor 22 will be interrupted so that the emitter-collector path thereof will change to blocked state. The current due to the stored ignition energy now must flow through the resistor 18 and blocking diode 20 to the gate electrode S of the thyristor 17 forming the short-circuiting switch 16 which will cause thyristor 17 to become conductive. The primary winding 6 of ignition coil 7 which, at that instant of time operates as a current source, is thus short-circuited and no inductive voltage pulse will arise at the spark plug 10. A current-limiting resistor can be included in the circuit between the cathode of the thyristor 17 and terminal A, if necessary.

The circuit has the particular advantage that it can be constructed as a separate unit and be associated with already existing ignition systems, regardless of type; thus, it can be associated with transistor-controlled ignition systems, mechanically switch-controlled ignition systems of whatever type, without interfering with the existing ignition system in any way, by merely connecting the terminals A, B across the primary of the ignition coil and grounding the remaining terminal C. No separate current supply or other connections need be made.

Various changes and modifications may be made within the scope of the inventive concept.

We claim:

1. Protective circuit for ignition system (1) of an internal combustion engine having an ignition coil (7), a master ignition switch (3) connected in series with the primary (6) of the coil (7) and a source of current (2, 4, 5);

a controlled switch (8) in series with the primary of the coil (7) which, upon closing thereof, and the master switch (3) being closed, permits current flow through the primary of the coil to store energy therein and, upon opening of the controlled switch, provides an inductive voltage pulse to the secondary (9) of the coil (7) to generate an ignition spark, and comprising, in accordance with the invention, a protective circuit branch (14, 15) connected in parallel to the primary (6) of the ignition coil (7) to prevent generation of an inductive sparking pulse due to inductive current when the controlled switch (8) is closed and the master ignition switch (3) is opened, including a controlled auxiliary semiconductor short-circuiting switch (16) connected in parallel across the primary (6) of the ignition coil and in normally open condition to shortcircuit the inductive current, when controlled to close, and auxiliary control circuit means (18, 19, 21) sensing a. closed condition of the controlled switch (8) and b. opening of the master ignition switch (3)

and then providing a control output pulse, said control output pulse being applied to and controlling the auxiliary semiconductor short-circuiting switch (16) to close, and thus short-circuit the inductive current from the ignition coil (7).

2. System according to claim 1, wherein the auxiliary control circuit means controlling the auxiliary semiconductor short-circuiting switch (16) comprises two serially connected resistors (18, 19) having a common junction, the auxiliary controlled switch (21) having its main current path connected to the common junction and being controlled to be conductive when the master ignition switch (3) is closed and opening upon opening of the master ignition switch;

said common junction being further connected to the control electrode applying a portion of the inductive current from the ignition coil (7) to the control electrode of the auxiliary short-circuiting semiconductor switch (16) upon opening of the master ignition switch (3) and with the controlled switch (8) closed, said auxiliary controlled switch (21) permitting draining of the portion of the inductive current during normal operation of the ignition system.

3. System according to claim 2, wherein the auxiliary controlled switch (21) comprises a transistor (22) and the main current path is the emitter electrode — collector electrode path thereof.

4. System according to claim 3, wherein one of the electrodes of the auxiliary control transistor (22) is connected to one terminal of the source of current (2, 4, 5).

5. System according to claim 1, wherein the auxiliary semiconductor short-circuiting switch (16) comprises the anode-cathode path of a thyristor (17).

6. System according to claim 2, wherein the auxiliary semiconductor short-circuiting switch (16) comprises the anode-cathode path of a thyristor (17);

and wherein one (18) of the serially connected resistors (18, 19) is connected across the gate electrode — main electrode control path of the thyristor and has a resistance value which is high with respect to the resistance of the other (19) of the resistors, to provide a positive control pulse to the thyristor gate upon opening of the master ignition switch (3) and with the auxiliary control switch (21) likewise open.

7. System according to claim 6, wherein the auxiliary controlled switch (21) comprises a transistor (22) and the main current path is the emitter electrode — collector electrode path thereof.

8. A spurious pulse suppression add-on unit for combination with automotive ignition systems comprising the protective system of claim 6 and having accessible terminals (A, B, C), said accessible terminals being connectable across the primary terminals of the ignition coil (7) of the ignition system, respectively, and a further terminal being connectable to the ground or chassis connection (5) of the source of current (2, 4, 5).

9. The unit of claim 8, wherein the auxiliary controlled switch (21) comprises a transistor (22) and the main current path is the emitter electrode — collector electrode path thereof.

10. A spurious pulse suppression add-on unit for combination with automotive ignition systems
comprising the protective system of claim 3
and having accessible terminals (A, B, C), said accessible terminals being connectable across the primary terminals of the ignition coil (7) of the ignition system, respectively, and a further terminal being connectable to the ground or chassis connection (5) of the source of current (2, 4, 5).

* * * * *